US008649726B2

(12) United States Patent
Kadowaki

(10) Patent No.: US 8,649,726 B2
(45) Date of Patent: Feb. 11, 2014

(54) SHUTTER DEVICE, TONER STORAGE UNIT AND IMAGE FORMING APPARATUS

(75) Inventor: Hideaki Kadowaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 221 days.

(21) Appl. No.: 13/107,154

(22) Filed: May 13, 2011

(65) Prior Publication Data

US 2011/0280613 A1 Nov. 17, 2011

(30) Foreign Application Priority Data

May 13, 2010 (JP) ..... 2010-110754

(51) Int. Cl.
*G03G 21/12* (2006.01)
*G03G 15/08* (2006.01)

(52) U.S. Cl.
USPC ..... 399/360; 399/102

(58) Field of Classification Search
USPC ..... 399/102, 106, 358, 360
See application file for complete search history.

(56) References Cited

U.S. PATENT DOCUMENTS 5,383,578 A * 1/1995 Nishimura ..... 399/360 X
6,266,511 B1 * 7/2001 Murakami et al. ..... 399/358
6,438,345 B1 8/2002 Ban et al.
6,782,235 B2 * 8/2004 Serizawa et al. ..... 399/360
6,882,821 B2 * 4/2005 Jeong et al. ..... 399/358
8,224,225 B2 * 7/2012 Sakurai ..... 399/360
2008/0124119 A1 * 5/2008 Oda ..... 399/120
2010/0080600 A1 * 4/2010 Okamoto et al. ..... 399/360 X

FOREIGN PATENT DOCUMENTS

JP 2000-347493 12/2000
JP 2004-170747 6/2004
JP 2009-168856 7/2009

* cited by examiner

*Primary Examiner* — Sandra Brase
(74) *Attorney, Agent, or Firm* — Nixon & Vanderhye, P.C.

(57) ABSTRACT

A shutter device includes a main body and a seal member. The main body is an annular body fitted around an outside of one end of a cylindrical tube which includes a discharge outlet in a part of the circumferential face near the end in the axial direction, and includes a first opening having a same shape as the discharge outlet and a second opening having a first opening end and a second opening end. The seal member has a length equal to a distance from a vicinity of the first opening end on an outer circumferential face of the main body, passing across the first opening, the second opening end and the first opening on an inner circumferential face of the main body in the stated order, to a vicinity of the second opening end.

10 Claims, 9 Drawing Sheets

SHUTTER DEVICE, TONER STORAGE UNIT AND IMAGE FORMING APPARATUS

CROSS REFERENCE

This Nonprovisional application claims priority under 35 U.S.C. §119(a) on Patent Application No. 2010-110754 filed in Japan on May 13, 2010, the entire contents of which are hereby incorporated by reference.

BACKGROUND OF THE INVENTION

The present invention relates to a shutter device that selectively opens and closes a discharge outlet through which powder passes, a toner storage unit that stores toner discharged from a discharge outlet opened/closed by the shutter device, and an image forming apparatus including this toner storage unit.

Some electrophotography image forming apparatuses are configured to supply toner to a developer tank from a toner container that is detachably attached to the apparatus. Electrophotography image forming apparatuses collects toner remaining on a photoreceptor after a transfer step to a toner tank.

Toner storage units including a developer tank and a toner tank store toner conveyed by a toner conveyance section. The toner conveyance section is configured to discharge toner conveyed by the rotation of the conveyance screw through a discharge outlet formed at one end portion of the cylindrical body to the developer tank or the toner tank. The discharge outlet is selectively opened/closed by a shutter device.

The shutter device includes a shutter member that is an annular body rotatably fitted around the outside of one end portion of the cylindrical body of the toner conveyance section, the shutter member including an opening with substantially the same shape of the discharge outlet as described in JP 2009-168856 A, for example. The rotation of the shutter member to let the opening thereof opposed to the discharge outlet allows toner to be discharged through the discharge outlet into the developer tank.

Between the inner circumferential face of the shutter member and the cylindrical body of the toner conveyance section and between the outer circumferential face of the shutter member and the recess of the developer tank or the toner tank are provided seal members to prevent the leakage of toner.

Disposing the individual seal members between the inner circumferential face of the shutter member and the cylindrical body of the toner conveyance section and between the outer circumferential face of the shutter member and the recess of the developer tank or the toner tank, however, makes an assembly process complicated because of an increase in the number of components. That is, such a configuration requires an operation to attach the seal members individually at the inner circumferential face of the shutter member or the circumferential face of the cylindrical body of the toner conveyance section and at the outer circumferential face of the shutter member or the inner circumferential face of the recess. Such a problem occurs not only in toner storage units but also generally in devices letting powder discharged through a discharge outlet opened/closed by a shutter member.

It is an object of the present invention to provide a shutter device, a toner storage unit and an image forming apparatus facilitating the attachment of a seal member to an inner circumferential face and an outer circumferential face of a shutter member, thus enabling a simple assembly process.

SUMMARY OF THE INVENTION

A shutter device of the present invention includes a main body and a seal member. The main body is an annular body fitted around an outside of one end of a cylindrical tube having a discharge outlet in a part of the circumferential face near the one end in the axial direction. The main body includes a first opening having the same shape as the discharge outlet. The main body is rotatable within a predetermined range between an open position and a close position, at the open position the first opening being opposed to the discharge outlet, and at the close position the first opening being away from the discharge outlet. The main body includes a second opening at a position not opposed to the discharge outlet during rotation within the predetermined range, the second opening including a first opening end and a second opening end that are parallel to the axial direction and having a length larger than the first opening. The seal member has a length equal to a distance from a vicinity of the first opening end on an outer circumferential face of the main body, passing across the first opening, the second opening end and the first opening on an inner circumferential face of the main body in the stated order and to a vicinity of the second opening end. The seal member includes a first hole and a second hole at two parts opposed to the first opening, the first hole and the second hole having at minimum a same shape as the first opening. The seal member is attached to the outer circumferential face and the inner circumferential face of the main body, while being folded at the second opening end.

DETAILED DESCRIPTION OF THE INVENTION

The following describes a shutter device, a toner storage unit and an image forming apparatus according to the present invention, with reference to the drawings.

Figure 1:
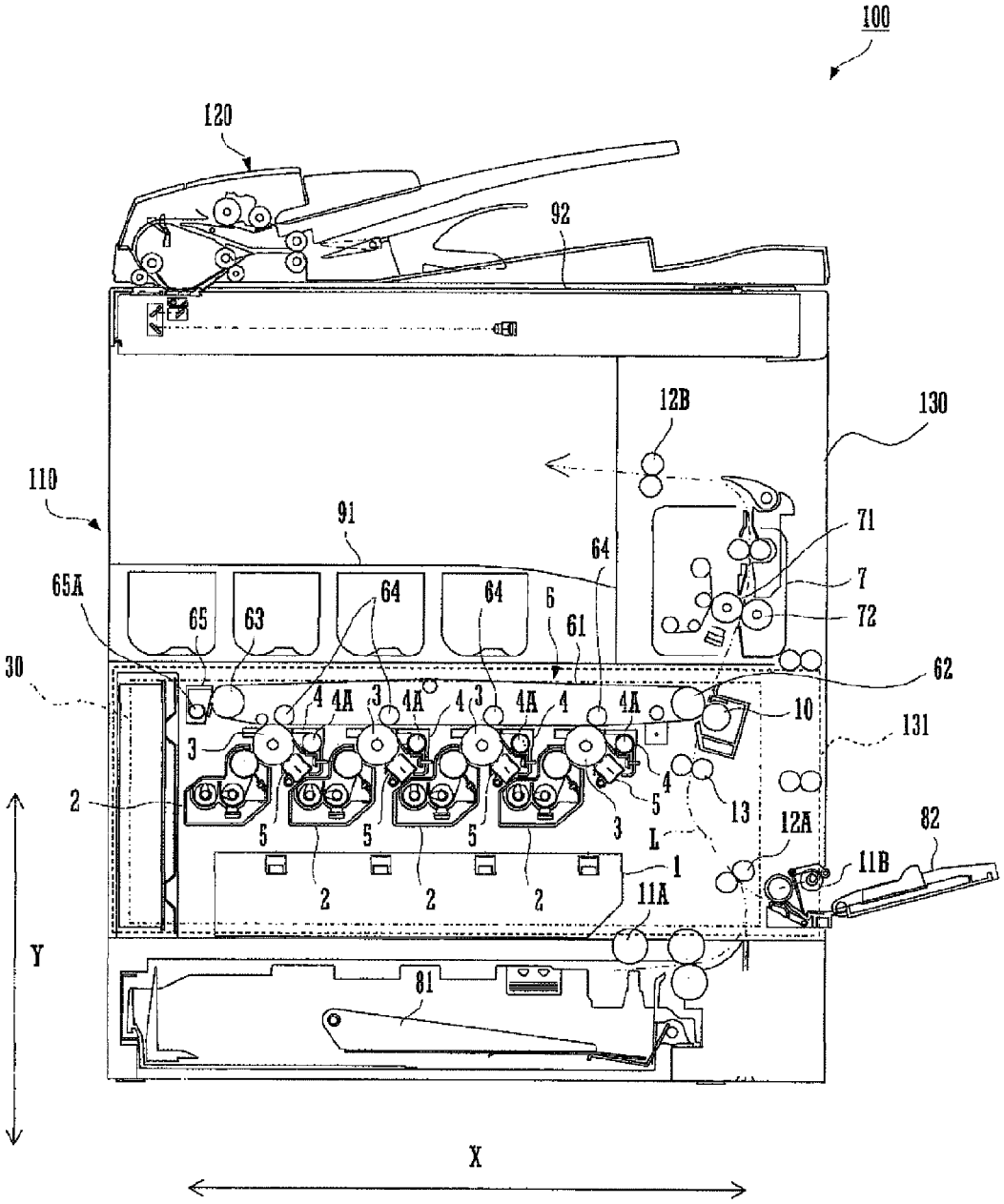
FIG. 1 is a front elevation view illustrating the overall configuration of an image forming apparatus according to one embodiment of the present invention.

As illustrated in FIG. 1, an image forming apparatus 100 includes an image forming section 110, a document reader 120 and a casing 130 housing the image forming section 110, and the image forming apparatus 100 performs multicolored or single-colored printing processing to a sheet in accordance with image data.

The document reader 120 is disposed above the image forming section 110, and includes a document platen 92 made of transparent glass on which a document is placed. The document reader 120 automatically conveys a document onto the document platen 92, reads an image of the document, and outputs image data to the image forming section 110.

The image forming section 110 includes an exposure unit 1, a development unit 2, a photoreceptor drum 3, a cleaner unit 4, a charger 5, an intermediate transfer belt unit 6, a fixing unit 7, a toner storage unit 30, a paper feeding cassette 81, a copy receiving tray 91 and the like. The image forming section 110 forms images in an electrophotographic manner.

The development unit 2, the photoreceptor drum 3, the charger 5 and the cleaner unit 4 are provided in each of four image stations corresponding to color images in black (K), cyan (C), magenta (M) and yellow (Y). Each image station forms a toner image of the corresponding color on the surface of the photoreceptor drum 3.

The cleaner unit 4 is provided with a pipe 4A (corresponding to a toner conveyance section of the present invention) including a conveyance screw therein. The cleaner unit 4 collects toner remaining on the periphery of the photoreceptor drum 3, and conveys the toner via the pipe 4A.

The charger 5 is of a charger type that uniformly charges the surface of the photoreceptor drum 3 at a predetermined electrical potential.

The exposure unit 1 is a laser scanning unit (LSU) provided with a laser emitting section, a reflective mirror and the like. The exposure unit 1 exposes the charged surface of the photoreceptor drum 3 with laser light modulated using image data, and forms an electrostatic latent image on the surface of the photoreceptor drum 3 in accordance with the image data. The development unit 2 makes the electrostatic latent image formed on the photoreceptor drum 3 visible with toner in four colors (YMCK).

The intermediate transfer belt unit 6 is disposed above the photoreceptor drum 3, and includes an intermediate transfer belt 61, a driving roller 62, an idle roller 63, an intermediate transfer roller 64 and a cleaning unit 65. Four intermediate transfer rollers 64 are provided corresponding to the colors of YMCK. The cleaning unit 65 is provided with a pipe 65A (corresponding to a toner conveyance section of the present invention) including a conveyance screw therein. The cleaning unit 65 collects toner remaining on the intermediate transfer belt 61 and conveys the toner via the pipe 65A.

The paper feeding cassette 81 stores sheets used for image formation, and is disposed below the exposure unit 1 of the image forming section 110. A manual paper feeding cassette 82 is for placing a sheet used for image formation thereon. The copy receiving tray 91 provided above the image forming section 110 stores a sheet with an image formed thereon at the image forming section 110.

The image forming section 110 is provided with a sheet conveyance path L conveying a sheet in the paper feeding cassette 81 or on the manual paper feeding cassette 82 to the copy receiving tray 91 via a transfer roller 10 and the fixing unit 7. The sheet conveyance path L is a conveyance path leading from the paper feeding cassette 81, or the manual paper feeding cassette 82 to the copy receiving tray 91. Along the sheet conveyance path L, pickup rollers 11A and 11B, a conveyance roller pair 12A, a paper stop roller pair 13, the transfer roller 10, the fixing unit 7 and a conveyance roller pair 12B are disposed in this order from the upstream side to the downstream side.

The pickup roller 11A is provided in the vicinity of an end of the paper feeding cassette 81 so as to pick up sheets one by one from the paper feeding cassette 81 and supply the paper to the sheet conveyance path L. The pickup roller 11B is provided in the vicinity of an end of the manual paper feeding cassette 82 so as to pick up sheets one by one from the manual paper feeding cassette 82 and supply the paper to the sheet conveyance path L.

The paper stop roller pair 13 stops a sheet conveyed via the sheet conveyance path L once, and thereafter resumes the conveyance of the sheet at a timing when the front end of the sheet coincides with the front end of a toner image on the intermediate transfer belt 61 at the position where the driving roller 62 and the transfer roller 10 are opposed to each other. The transfer roller 10 transfers the toner image on the intermediate transfer belt 61 to the sheet.

The fixing unit 7 is disposed above the transfer roller 10, includes a roller pair of a heat roller 71 and a pressure roller 72, and heats and pressurizes a sheet with a toner image transferred thereon to fix the toner image on the sheet surface.

The casing 130 includes a front panel 131 facing the toner storage unit 30. The front panel 131 is supported openably to the front face side at both lower ends in the longitudinal direction. The toner storage unit 30 is mounted detachably to the front face side of the image forming section 110.

Figure 2A:
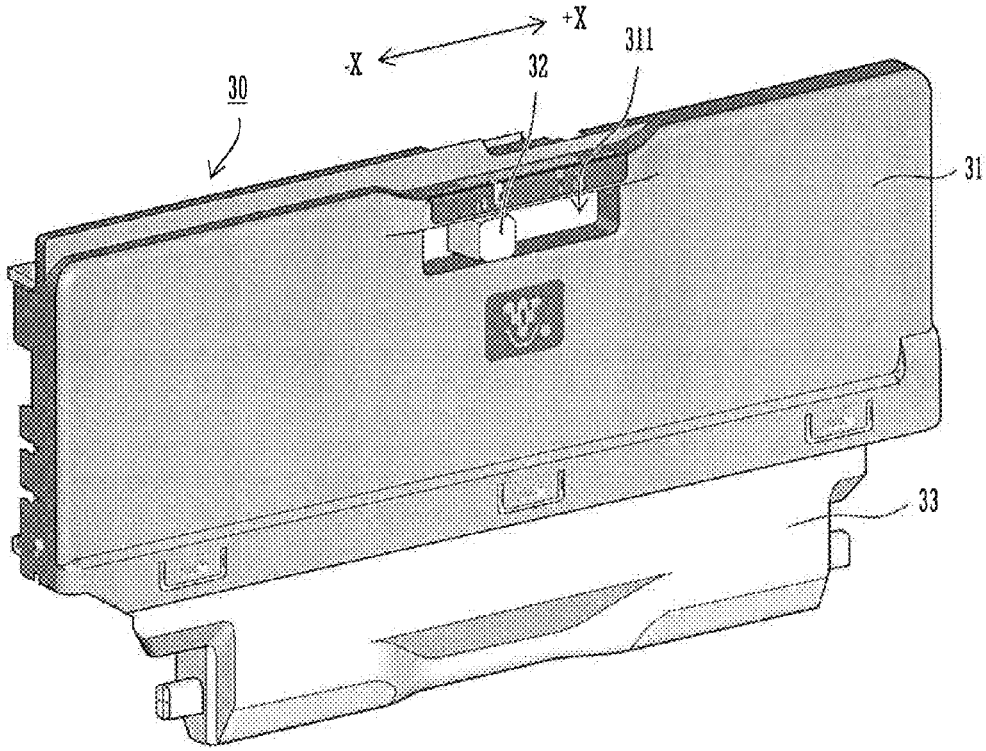
FIGS. 2A and 2B are an outline view and a perspective view of a toner storage unit according to one embodiment of the present invention viewed from a front face side.
Figure 2B:
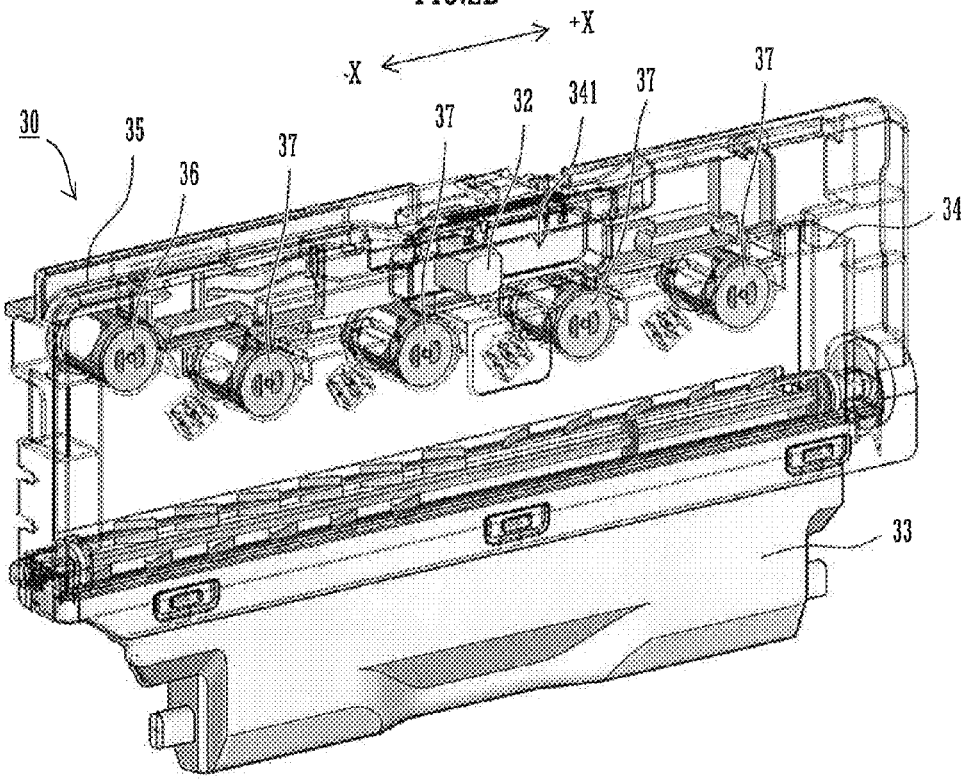

As illustrated in FIG. 2A and FIG. 2B, the toner storage unit 30 of the present invention includes a cover 31, a operating section 32, a waste toner tank 33, a frame 34, a moving member 35 and open/close members (corresponding to a shutter device of the present invention) 36 and 37.

The cover 31 covers the front face of the frame 34. The cover 31 includes a rectangular opening 311 formed therein having a longitudinal direction in the X-axis direction. Through the opening 311, the operating section 32 is exposed.

The frame 34 has an opening 341 on the front face side thereof, the opening 341 having the same shape as that of the opening 311 formed in the cover 31. Above the frame 34 is attached the moving member 35 movably in the X-axis direction. The moving member 35 is formed integrally with the operating section 32. The operating section 32 protrudes from the opening 341. As the operating section 32 moves within the opening area of the opening 311 in the X-axis direction, the moving member 35 accordingly moves in the X-axis direction.

Below the moving member 35 are provided the open/close members 36 and 37. When the toner storage unit 30 is mounted to the image forming section 110, the open/close members 36 and 37 are connected to the pipe 65A and the pipes 4A, respectively. The open/close members 36 and 37 are supported rotatably between a open position allowing the pipe 65A and the pipes 4A, respectively, to communicate with an exit path SP (see FIG. 6), and a close position not allowing the communication.

Below the frame 34 is provided the waste toner tank 33. The waste toner tank 33 is a reservoir to reserve toner discharged from the open/close members 36 and 37 via the exit path SP.

Figure 3:
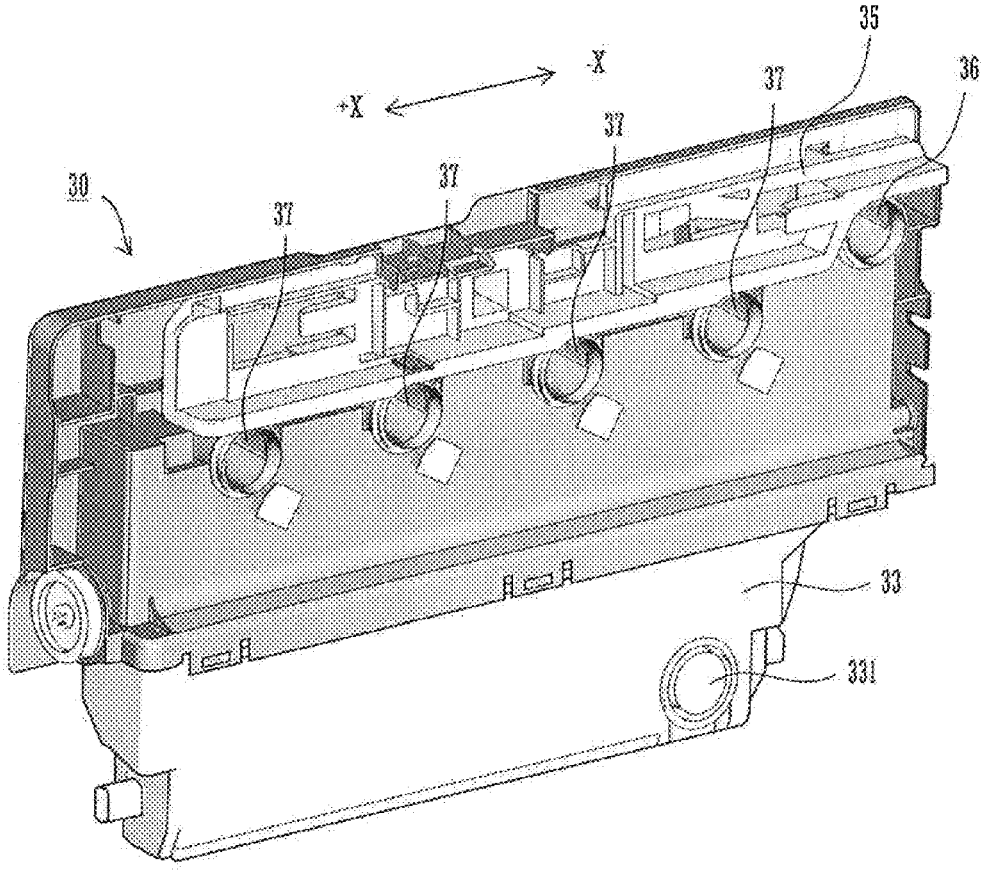
FIG. 3 is a perspective view of the toner storage unit viewed from a rear face side.

The exit path SP is a gap letting the open/close members 36 and 37 communicate with the waste toner tank 33, and is formed substantially across the overall width of the toner storage unit 30 between the periphery of the open/close members 36 and 37 positioned above and the waste toner tank 33 positioned below. Thereby, toner discharged via the open/close members 36 and 37 can be reserved in the waste toner tank 33. As illustrated in FIG. 3, the waste toner tank 33 is provided with an open/close section 331 on the rear face side. Waste toner reserved in the waste toner tank 33 can be discarded through the open/close section 331.

Figure 4:
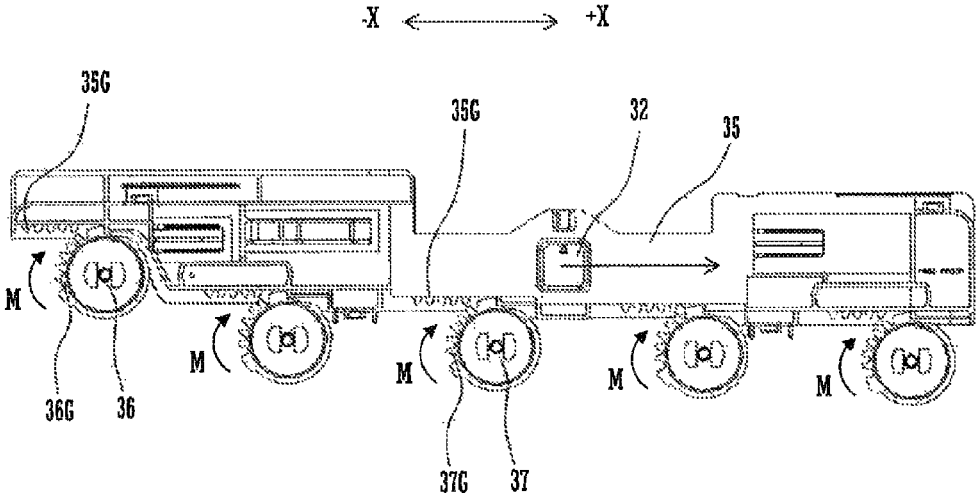
FIG. 4 explains an opening/closing operation of an open/close member as a moving member moves.

As illustrated in FIG. 4, the moving member 35 includes gears 35G formed along the lower face in the longitudinal direction, the gears 35G being detachably and attachably meshing with each of the open/close members 36 and 37.

Around the open/close members 36 and 37 are formed gears 36G and 37G detachably and attachably meshing with the gears 35G. As the moving member 35 moves from the −X direction to the +X direction, the moving member 35 makes the gears 35G mesh with the gears 36G and 37G of the open/close members 36 and 37, so as to rotate the open/close members 36 and 37 in the direction of arrow M from the close position to the open position. Conversely as the moving member 35 moves from the +X direction to the −X direction, the moving member 35 makes the gears 35G mesh with the gears 36G and 37G of the open/close members 36 and 37, so as to rotate the open/close members 36 and 37 in the reverse direction of arrow M from the open position to the close position. Thereby, the open/close members 36 and 37 perform opening/closing operations along with the movement of the moving member 35.

The moving member 35 is disposed above a portion of the frame 34 forming the exit path SP. This prevents toner passing through the exit path SP from adhering to the moving member 35, thus leading to the effect of preventing the failure of the gears 35G in smooth mesh with the gears 36G and 37G because of toner adhered to the moving member 35.

The following describes the configuration of the open/close members 36 and 37. Since the open/close members 36 and 37 have the same configuration, the following describes the open/close member 37 as an example. The pipe 65A and the pipes 4A each connecting with one of the open/close members 36 and 37 also have the same configuration.

Figure 5A:
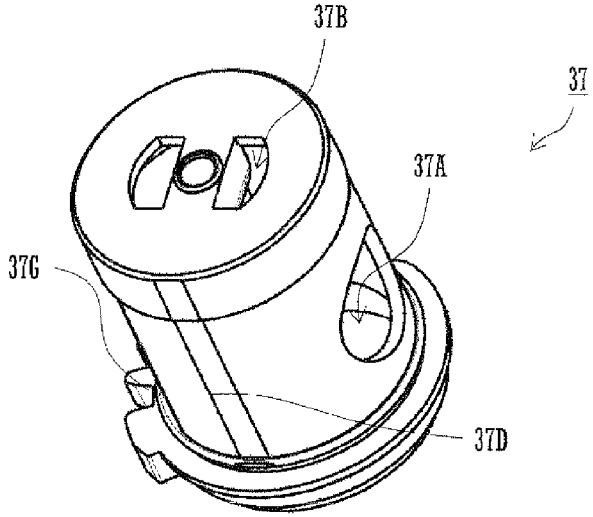
FIGS. 5A to 5C are a perspective view on the rear face side, a perspective view on the front face side and a partially broken perspective view on the rear face side illustrating the configuration of an open/close member.
Figure 5B:
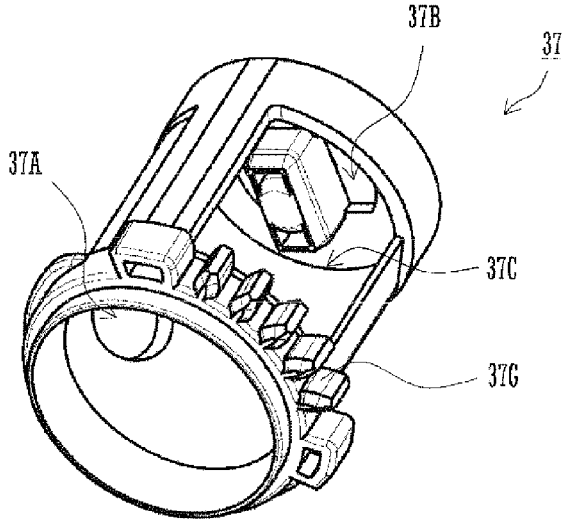
Figure 5C:
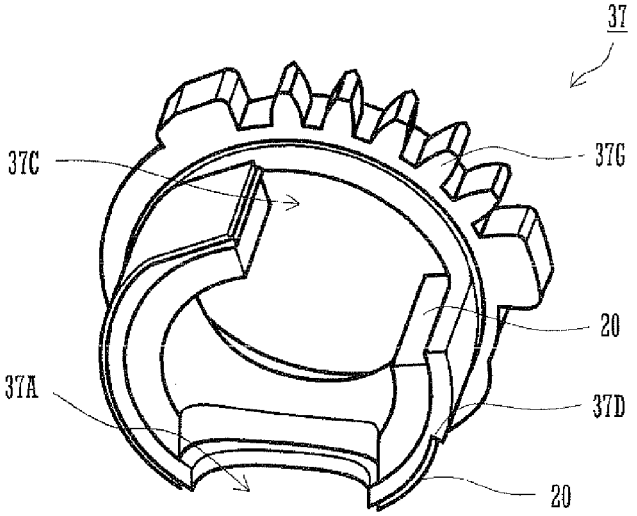

As illustrated in FIG. 5, the open/close member 37 includes an annular body (corresponding to a main body of the present invention) having one end provided with a fitting section 37B as a rectangular opening and the other end as an opening across the entire face. The open/close member 37 includes gears 37C partially formed around the circumferential face. The open/close member 37 includes a rectangular opening 37C (corresponding to a second opening of the present invention) in the circumferential face on the side of the gears 37G formed, and includes a round opening 37A (corresponding to a first opening of the present invention) at a part of the circumferential face on the side of the gears 37G not formed. The opening 37C is larger than the opening 37A, and is formed on the same circumference as that of the opening 37A. The open/close member 37 is formed so that the opening 37C is positioned on the upper semicircle side of the circumferential wall while letting the opening 37A face downward (see FIG. 7A). The open/close member 37 further includes a recess 37D formed in the vicinity of the opening 37C as a starting position for the attachment of a seal member 20. The recess 37D is posited on the upper semicircle side of the circumferential wall while letting the opening 37A face downward. On the outer face and the inner face of the A circumferential wall of the open/close member 37, the seal member 20 is attached.

Figure 6:
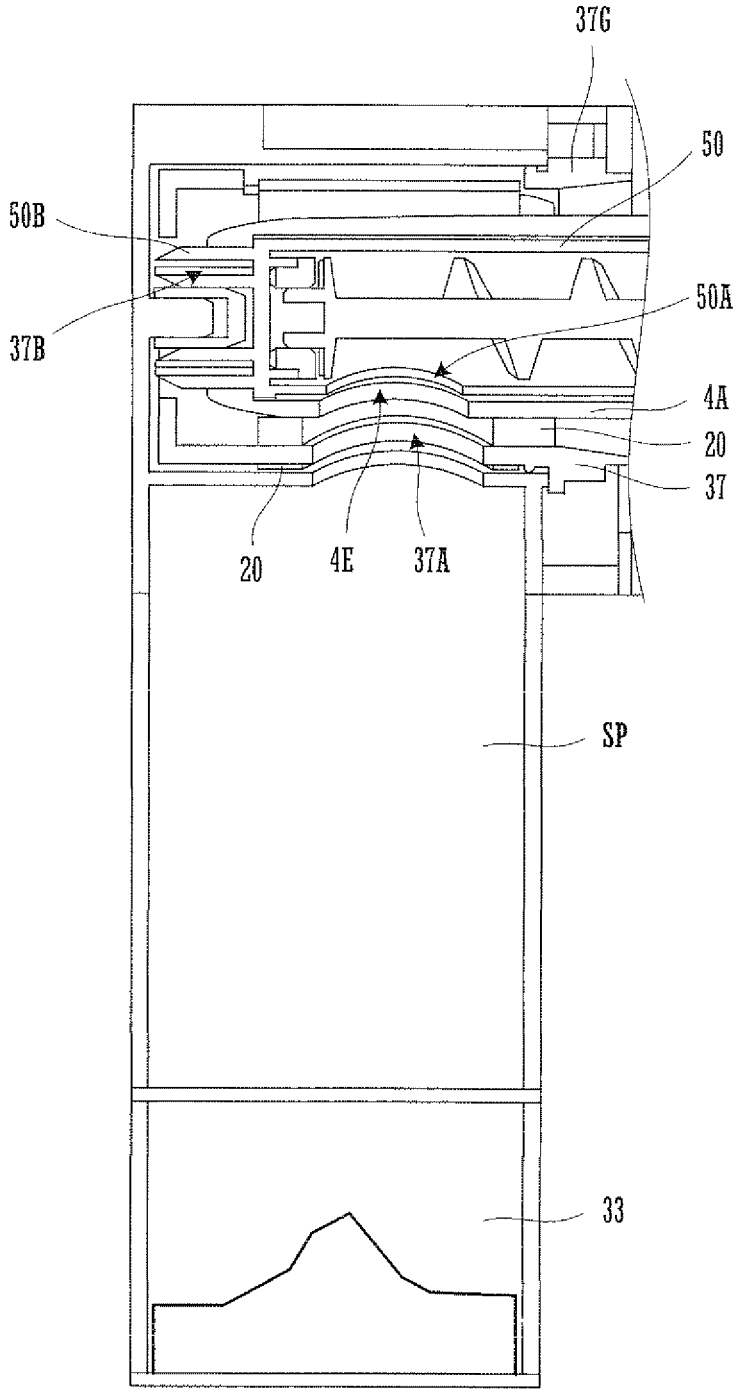
FIG. 6 explains an opening/closing operation of an open/close member.

As illustrated in FIG. 6, the pipe 4A includes a hollow cylindrical tube and is provided with an outlet 41 (corresponding to a toner outlet of the present invention) at a lower portion of the circumferential wall. The pipe 4A is inserted and fitted to the open/close member 37 so that open/close member 37 is rotatable. The opening 37A of the open/close member 37 is provided on the circumferential wall at a position coaxially with the outlet 41 when the open/close member 37 is at the open position.

At an end of the pipe 4A on the front face side, an open/close member 50 (corresponding to an internal shutter member of the present invention) is rotatably inserted and fitted along the inner wall of the pipe 4A. The open/close member 50 has a hollow cylindrical shape, and includes an opening 50A (corresponding to a third opening of the present invention) and a protrusion 50B formed therein.

The protrusion 50B has a rectangular parallelepiped shape, is formed at a part of a front face in a round shape, and can be inserted and detached with respect to the fitting section 37B of the open/close member 37. The opening 50A of the open/close member 50 is provided in the circumferential wall at a position coaxially with the opening 37A of the open/close member 37 while letting the protrusion 50B fit with the fitting section 37B. This configuration allows the open/close member 50 to rotate operatively associated with the rotation of the open/close member 37. This configuration further allows the opening 37A and the opening 50A to be kept coaxially.

Figure 7A:
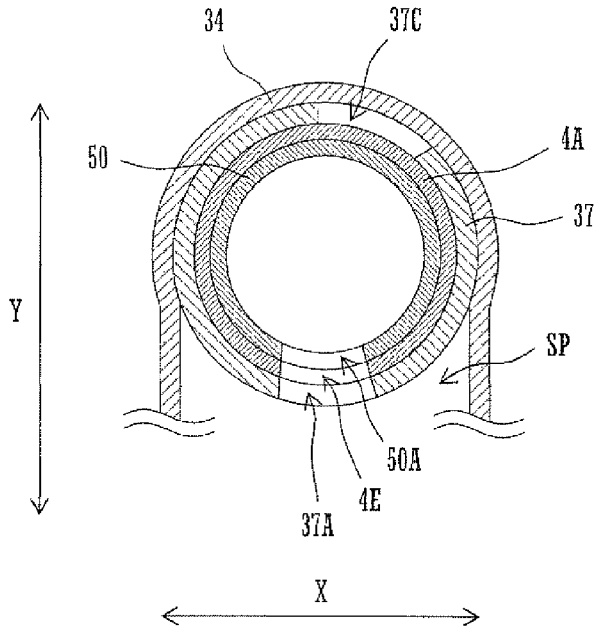
FIGS. 7A and 7B explain the configuration of an open/close member at a open position and at a close position, respectively.
Figure 7B:
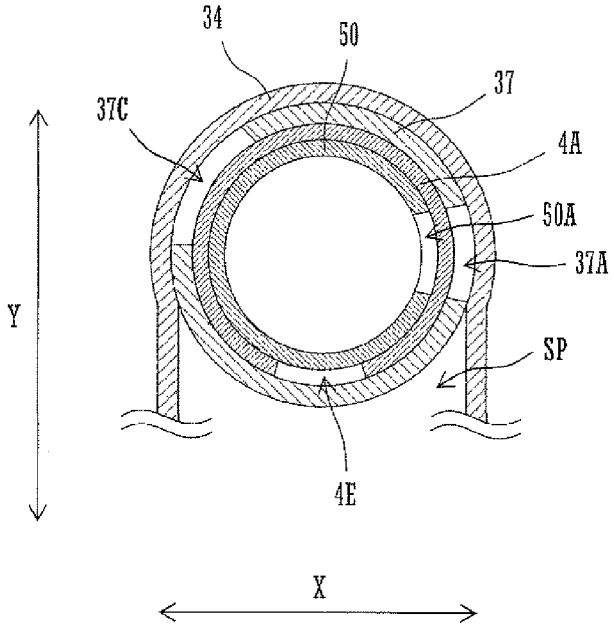

As illustrated in FIG. 7A, the open/close member 37 at the open position disposes the opening 37A and the opening 50A of the open/close member 50 downward so as to face the outlet 4E. Thereby, the open/close member 37 releases the outlet 4E and allows the pipe 4A to communicate with the exit path SP. On the other hand, as illustrated in FIG. 7B, the open/close member 37 at the close position disposes the opening 37A and the opening 50A of the open/close member 50 so as not to face the outlet 4E and on the upper semicircle side of the circumferential wall of the pipe 4A. Thereby, the open/close member 37 blocks the outlet 4E so as to keep the pipe 4A from communicating with the exit path SP. Note here that the seal member 20 is omitted in FIG. 7 for the sake of simplicity.

Thereby, even when the toner storage unit 30 is removed from the image forming section 110 while positioning the open/close member 37 at the close position, the open/close member 50 still blocks the outlet 4E, thus preventing the leakage of waste toner remaining in the pipe 4A. Herein, although in the present embodiment the open/close member 50 is attached to each of the pipes 4, the open/close member 50 does not have to be provided when there is no need to switch between open/close states of the outlet 4E.

Figure 8A:
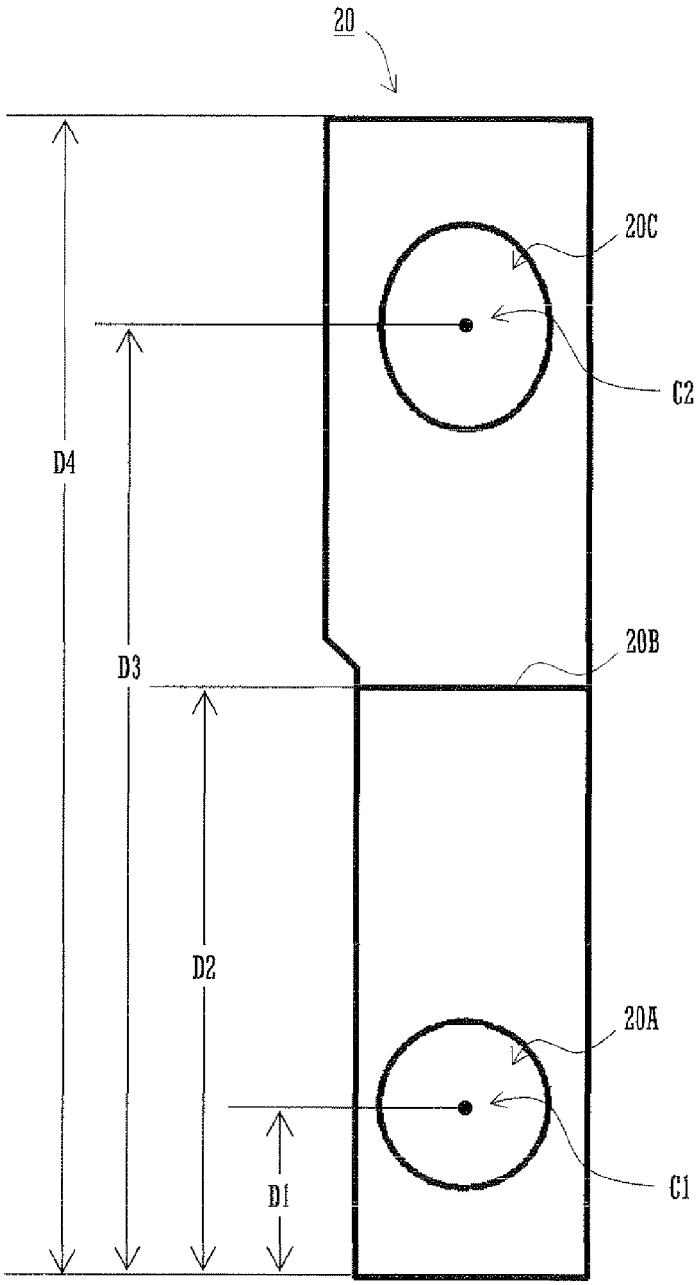
FIGS. 8A and 8B are a plan view and a side view of a seal member.
Figure 8B:
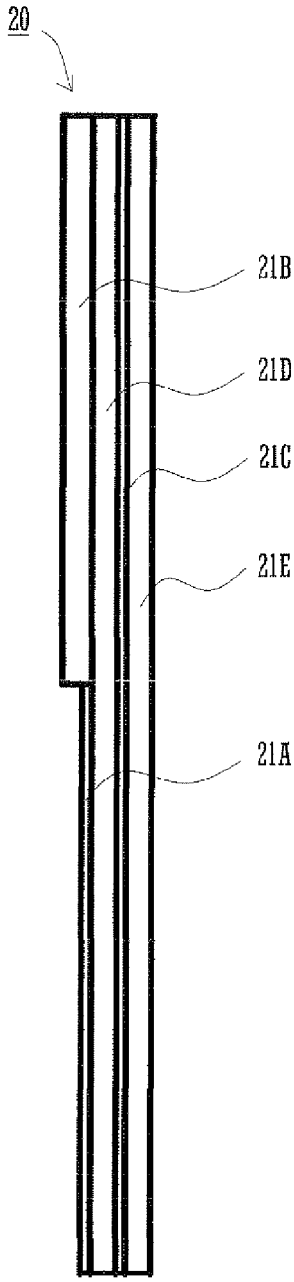
Figure 9A:
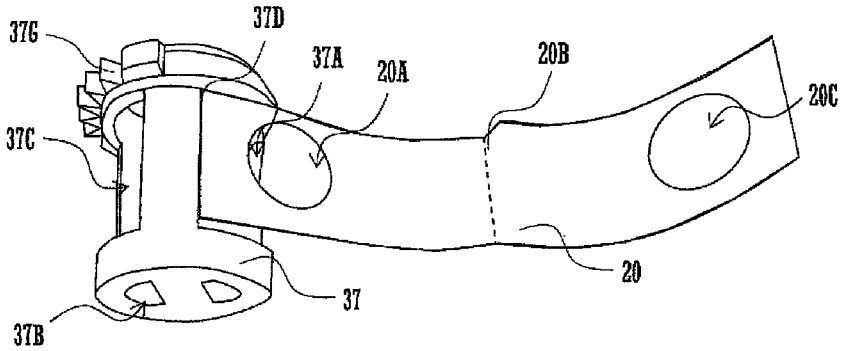
FIGS. 9A to 9D illustrate a method for attaching a seal member to an open/close member step by step.
Figure 9B:
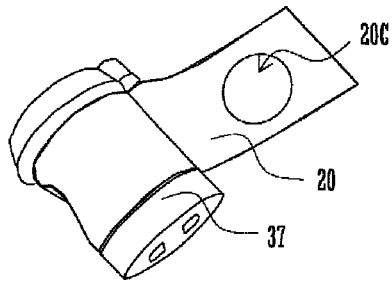
Figure 9C:
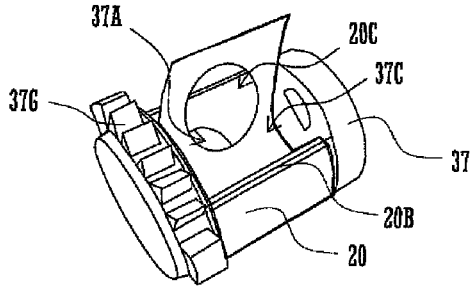
Figure 9D:
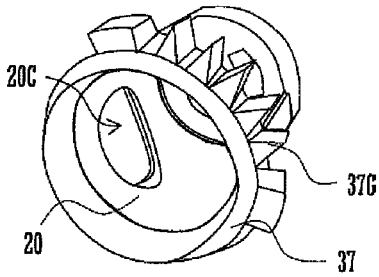

As illustrated in FIG. 8, the seal member 20 attached to the open/close member 37 has a rectangular shape, and includes a round opening 20A, a slit 20B and an oval opening 20C formed therein. Let herein that a distance from the recess 37D formed on the outer face of the circumferential wall of the open/close member 37 to the center of the opening 37A is D1, a distance from the recess 37D formed on the outer face of the circumferential wall of the open/close member 37 to an opening end of the opening 37C is D2, a distance from the recess 37D formed on the outer face of the circumferential wall of the open/close member 37, turning to the inner face of the circumferential wall of the open/close member 37 at the opening end of the opening 37C and to the center of the opening 37A is D3, and a distance from the recess 37D formed on the outer face of the circumferential wall of the open/close member 37, turning to the inner face of the circumferential wall of the open/close member 37 at the opening end of the opening 37C, and beyond the position opposed to the recess 37D before going across the opening end of the opening 37C is D4.

The seal member 20 is formed to have a length of the distance D4 in the longitudinal direction. The opening 20A has a center C1 at the position of the distance D1 from one side of the seal member 20 in the longitudinal direction, and has the same size as the opening 37A. The slit 20B is formed at the position of the distance D2 from the one side of the seal member 20 in the longitudinal direction. The opening 20C has a center C2 at the position of the distance D3 from the one side of the seal member 20 in the longitudinal direction and is formed as an oval opening having a minor axis equal to the diameter of the opening 37A.

The seal member 20 includes a highly-foamed polyethylene sheet 21A from one side of the seal member 20 to the position of the distance D2 in the longitudinal direction, and polyurethane foam 21B from the position at the distance D2 to the position at the distance D4, which are bonded to an upper face of a polyethylene terephthalate 21C with a double-faced tape 21D. In the seal member 20, a double-faced tape 21E is attached to a lower face of the polyethylene terephthalate 21C as well. The seal member 20 is attached to the open/close member 37 with the double-faced tape 21E. The highly-foamed polyethylene sheet 21A is made of a material of 0.5 mm in thickness, having a sealing property. The polyurethane foam 21B is polyether-based polyurethane foam of 3.0 mm in thickness, which is made of a material having a property of preventing the scattering of toner. The polyethylene terephthalate 21C is a kind of plastics of 0.05 mm in thickness.

As illustrated in FIG. 9, the seal member 20 is attached along the outer face of the circumferential wall of the open/close member 37 while letting one side of the seal member 20 with the highly-foamed polyethylene sheet 21A bonded thereon coincide with the recess 37D of the open/close member 37. The seal member 20 is folded from the outer face to the inner face of the circumferential wall at the opening end of the opening 37C while letting the slit 20B coincide with the opening end, and then is attached along the inner face of the circumferential wall. As a result, the seal member 20 is attached so that the opening 20A is overlapped with the opening 37A of the open/close member 37 at the outer face of the circumferential wall and the opening 20C is overlapped with the opening 37A of the open/close member 37 at the inner face of the circumferential wall.

Thereby, simply attaching the seal member 20 as one sheet while letting the recess 37D and the opening end of the opening 37C of the open/close member 37 as reference positions coincide with one side of the seal member 20 in the short-length direction and the slit 20B, respectively, as standard positions allows the seal member 20 to be attached easily to the outer face and the inner face of the circumferential wall of the open/close member 37. Gaps of the open/close member 37 with the pipe 4A and the exit path SP can be blocked with the seal member 20 as one sheet, thus preventing the leakage of toner to the outside more securely. Further, since the seal member 20 is formed with the opening 20C having an oval shape with a minor axis equal to the diameter of the opening 37A, the seal member 20 does not block the opening 37A even when it is attached to the inner face of the circumferential wall of the open/close member 37.

Herein, the slit 20B may decrease the thickness of the seal member 20 by gaps, breaks or compression, for example. The slit 20B may be formed intermittently.

The present embodiment exemplifies the case where the moving member 35 is supported movably in the X-axis direction above the frame 34 so as to be shielded from the exit path SP. However, the present invention is not limited to this example. For instance, when the opening/closing operation of the open/close members 36 and 37 can be performed smoothly by the movement of the moving member 35, the moving member 35 may be disposed at a position so as to pass through the exit path SP.

Further, in the present embodiment, the cover 31 covers to hermetically seal the entire face of the toner storage unit 30 on the front face side except for the waste toner tank 33 and the operating section 32. This configuration can prevent the leakage of toner from the periphery of the open/close members 36 and 37 to the outside more securely. However, the cover 31 may be omitted depending on the specifications of the toner storage unit 30.

Moreover, although the toner storage unit 30 in the present embodiment includes a plurality of open/close members, the toner storage unit 30 may include at least one open/close member. The open/close member may be adapted to a toner conveyance section (not illustrated) that supplies toner to the development unit 2. In this case, a gap between the open/close member and the toner conveyance unit and a gap between the open/close member and the development unit 2 can be blocked easily with the seal member 20 as one sheet.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. A shutter device comprising:

a main body including an annular body fitted around an outside of one end of a cylindrical tube having a discharge outlet at a part in a circumferential face near the one end in an axial direction, and a first opening and a second opening; and a seal member, wherein the main body is rotatable within a predetermined range between an open position and a close position, at the open position the first opening be opposed to the discharge outlet, and at the close position the first opening being away from the discharge outlet, the first opening has a same shape of the discharge outlet, the second opening is formed at a position not opposed to the discharge outlet during rotation within the predetermined range, includes a first opening end and a second opening end that are parallel to the axial direction, and has a length larger than the first opening, the seal member has a length equal to a distance from a vicinity of the first opening end on an outer circumferential face of the main body, passing across the first opening, the second opening end and the first opening on an inner circumferential face of the main body, to a vicinity of the second opening end in this order, the seal member includes a first hole and a second hole at two parts opposed to the first opening, the first hole and the second hole having at minimum a same shape as the first opening, and the seal member is attached to the outer circumferential face and the inner circumferential face of the main body, while being folded at the second opening end.

2. The shutter device according to claim 1, wherein the main body includes a recess on the outer circumferential face in a range where the seal member is to be attached.

3. The shutter device according to claim 1, wherein the seal member has a lower face, at which an adhesive layer is disposed.

4. The shutter device according to claim 1, wherein the seal member includes a portion to be attached to outer circumferential face of the main body having a first thickness and a portion to be attached to the inner circumferential face of the main body having a second thickness, the first thickness being smaller than the second thickness.

5. The shutter device according to claim 1, wherein the seal member has an upper face, a portion of the upper face to be attached to the outer circumferential face of the main body including a material with a sealing property, and a portion of the upper face to be attached to the inner circumferential face of the main body including a material, with a property of preventing scattering of toner.

6. The shutter device according to claim 1, wherein the first hole is disposed at a part of the seal member to be attached to the outer circumferential face of the main body and has a same shape as the first opening, and the second hole is disposed at a part of the seal member to be attached to the inner circumferential face of the main body and has a shape larger than the first opening.

7. A toner storage unit, comprising:

the shutter device according to claim 1; and a toner tank that reserves toner discharged from the discharge cutlet.

8. The toner storage unit according to claim 7, further comprising an inner shutter member that includes an annular body fitted into the tube of the shutter device and rotates integrally with the main body, wherein the inner shutter member includes a third opening at a position opposed to the first opening of the shutter device and has a same shape as the discharge outlet.

9. An image forming apparatus, comprising:

the toner storage unit according to claim 8;

a toner conveyance section having the tube; and an image forming section that forms an image in electrophotographic manner, wherein the toner conveyance section conveys toner, in an axial direction in the tube, which remains on a photoreceptor after a transferring step of the image forming section.

10. An image forming apparatus, comprising:

the toner storage unit according to claim 7;

a toner conveyance section having the tube; and an image forming section that forms an image in an electrophotographic manner, wherein the toner conveyance section conveys toner, in an axial direction in the tube, which remains on a photoreceptor after a transfer step of the image forming section.

* * * * *